US008322411B2

(12) United States Patent
Kaul et al.

(10) Patent No.: US 8,322,411 B2
(45) Date of Patent: Dec. 4, 2012

(54) AXIALLY LOADED TAPERED HEAT SINK MECHANISM

(75) Inventors: Anmol Kaul, Katy, TX (US); Lennox E. Reid, Jr., Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 290 days.

(21) Appl. No.: 12/774,472

(22) Filed: May 5, 2010

(65) Prior Publication Data

US 2011/0272135 A1 Nov. 10, 2011

(51) Int. Cl.
*E21B 36/00* (2006.01)

(52) U.S. Cl. ..... 166/57; 166/302

(58) Field of Classification Search ..... 166/57, 166/302

See application file for complete search history.

(56) References Cited

U.S. PATENT DOCUMENTS

| | | | | |
|---|---|---|---|---|
| 6,641,434 | B2 | 11/2003 | Boyle et al. | |
| 6,986,282 | B2 | 1/2006 | Ciglenec et al. | |
| 7,114,562 | B2 | 10/2006 | Fisseler et al. | |
| 7,806,173 | B2 * | 10/2010 | Kaul et al. | 166/57 |
| 8,024,936 | B2 * | 9/2011 | Storm et al. | 62/3.7 |
| 2006/0144619 | A1 * | 7/2006 | Storm et al. | 175/17 |

* cited by examiner

*Primary Examiner* — William P Neuder

(74) *Attorney, Agent, or Firm* — Cathy Hewitt; Michael Flynn; Jody Lynn DeStefanis

(57) ABSTRACT

The present disclosure relates to heat dissipation apparatus that may be used within a downhole tool. The heat dissipation apparatus may include one or more of a cover configured to attach to a heat generating device, a thermal conduit thermally coupled to the cover, and a heat sink thermally coupled to the thermal conduit, in which the heat sink is configured to dissipate heat from the heat generating device through the cover and the thermal conduit.

20 Claims, 9 Drawing Sheets

752
750
754
756
757
758
760
759
764
762
764

AXIALLY LOADED TAPERED HEAT SINK MECHANISM

BACKGROUND OF THE DISCLOSURE

Producing reservoir wells involves drilling surface formations and monitoring various subsurface formation parameters. Drilling and monitoring typically involves using downhole tools having high-powered electronic devices. During operation, the electronic devices generate heat that often builds up in a downhole tool. This built up heat can be detrimental to the operation of the downhole tool.

A traditional technique for dissipating the heat generated by these electronic devices involves using heat sinks in a downhole tool. A heat sink is an object that typically absorbs and dissipates heat from another object through thermal contact, thermal conduction and/or heat transfer. Dissipating heat from an object with a high temperature may result in lowering the temperature of that object. For example, a heat sink is made from a material with high thermal conductivity and/or large heat capacity, such as aluminum or copper. Efficient function of a heat sink may rely on rapid transfer of thermal energy from the first object to the heat sink.

Further, the use of a thermally conductive material, such as a thermal gel, paste, grease, and/or other thermally conductive substances may increase the transfer of thermal. For example, the thermally conductive material may be applied to a surface between the heat sink and other objects. The use of the thermally conductive material may help minimize thermal resistance between the objects.

Dissipating heat generated by heat generating devices through the use of thermally conductive materials, such as heat sinks or thermal substances, may help prevent detrimental heat build up and help maintain a heat generating device at an operable temperature in a downhole tool.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
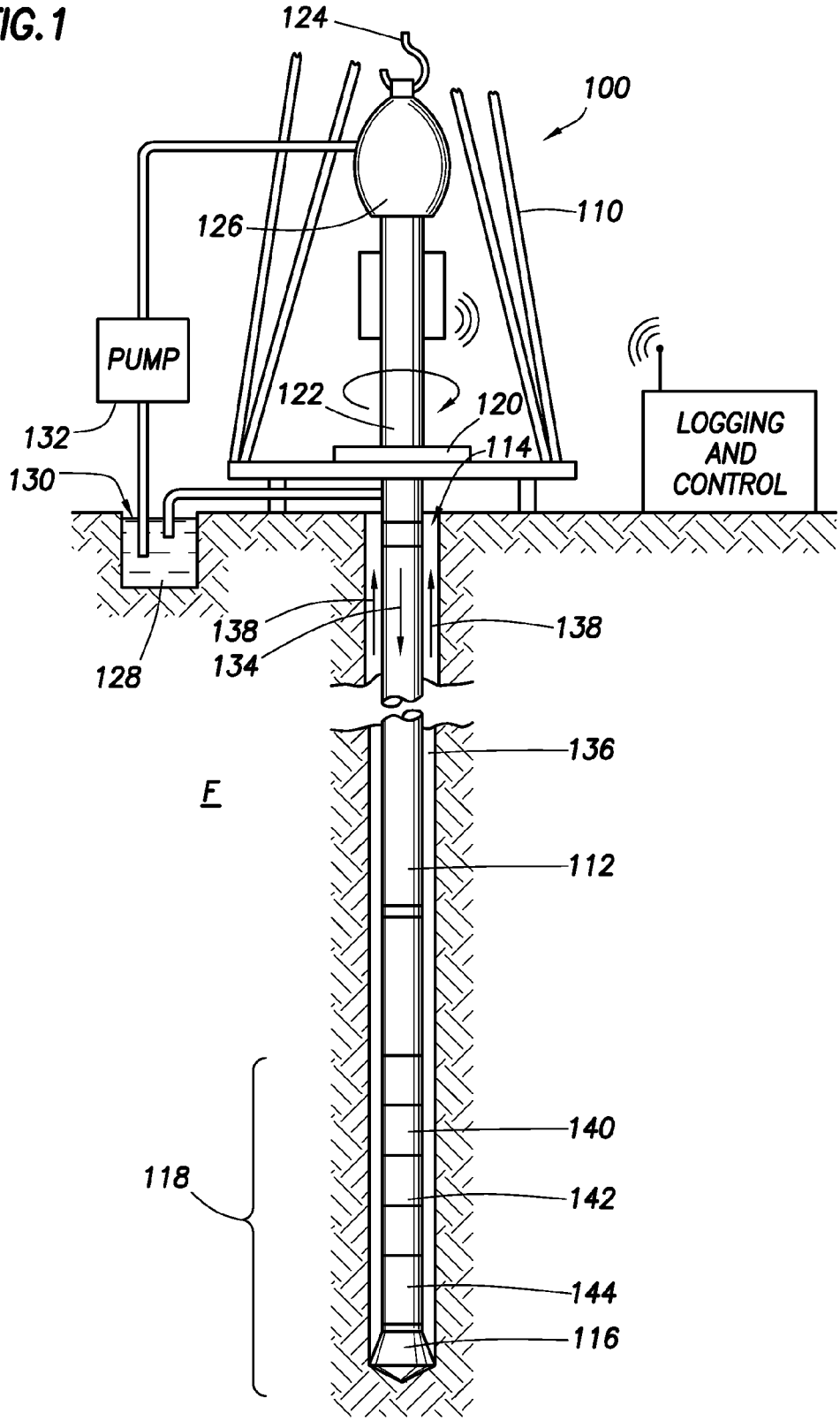
FIG. 1 shows a schematic view of a wellsite having an apparatus in accordance with one or more embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, a schematic view of a wellsite 100 having a drilling rig 110 with a drill string 112 suspended therefrom in accordance with one or more embodiments of the present disclosure is shown. The wellsite 100 shown, or one similar thereto, may be used within onshore and/or offshore locations. In this embodiment, a borehole 114 may be formed within a subsurface formation F, such as by using rotary drilling, or any other method known in the art. As such, one or more embodiments in accordance with the present disclosure may be used within a wellsite, similar to the one as shown in FIG. 1 (discussed more below). Further, those having ordinary skill in the art will appreciate that the present disclosure may be used within other wellsites or drilling operations, such as within a directional drilling application, without departing from the scope of the present disclosure.

Continuing with FIG. 1, the drill string 112 may suspend from the drilling rig 110 into the borehole 114. The drill string 112 may include a bottom hole assembly 118 and a drill bit 116, in which the drill bit 116 may be disposed at an end of the drill string 112. The surface of the wellsite 100 may have the drilling rig 110 positioned over the borehole 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

Further, an upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used in accordance with one or more embodiments without departing from the scope of the present disclosure. In such a top-drive system, the hook 124, swivel 126, and kelly 122 are replaced by a drive motor (electric or hydraulic) that may apply rotary torque and axial load directly to drill string 112.

The wellsite 100 may further include drilling fluid 128 (also known as drilling "mud") stored in a pit 130. The pit 130 may be formed adjacent to the wellsite 100, as shown, in which a pump 132 may be used to pump the drilling fluid 128 into the borehole 114. In this embodiment, the pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, in this embodiment, the drilling fluid 128 may exit the drill string 112 through one or more ports formed within the drill bit 116.

As such, the drilling fluid 128 may flow back upwardly through the borehole 114, such as through an annulus 136 formed between the exterior of the drill string 112 and the interior of the borehole 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the borehole 114) back to the surface of the wellsite 100. As such, this drilling fluid 128 may be filtered and cleaned and/or returned back to the pit 130 for recirculation within the borehole 114.

Though not shown in this embodiment, the drill string 112 may further include one or more stabilizing collars. A stabilizing collar may be disposed within and/or connected to the drill string 112, in which the stabilizing collar may be used to engage and apply a force against the wall of the borehole 114. This may enable the stabilizing collar to prevent the drill string 112 from deviating from the desired direction for the borehole 114. For example, during drilling, the drill string 112 may "wobble" within the borehole 114, thereby enabling the drill string 112 to deviate from the desired direction of the borehole 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components included therein, such as components to measure, process, and store information. Further, the bottom hole assembly 118 may include components to communicate and relay information to the surface of the wellsite.

As such, in this embodiment shown in FIG. 1, the bottom hole assembly 118 may include one or more logging-while-drilling ("LWD") tools 140 and/or one or more measuring-while-drilling ("MWD") tools 142. Further, the bottom hole assembly 118 may also include a steering-while-drilling system (e.g., a rotary-steerable system) and motor 144, in which the rotary-steerable system and motor 144 may be coupled to the drill bit 116.

The LWD tool 140 shown in FIG. 1 may include a thick-walled housing, commonly referred to as a drill collar, and may include one or more of a number of logging tools known in the art. Thus, the LWD tool 140 may be capable of measuring, processing, and/or storing information therein, as well as capabilities for communicating with equipment disposed at the surface of the wellsite 100.

Further, the MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. As such, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

A heat generating device such as a component of power electronics may be implemented in the LWD tool 140 and the MWD tool 142, among elements of the bottom hole assembly 118. As such, a heat dissipation apparatus in accordance with one or more embodiments of the present disclosure may be thermally coupled to the heat generating device. The heat dissipation apparatus may include one or more of a cover configured to attach to the heat generating device, a thermal conduit thermally coupled to the cover, and a heat sink thermally coupled to the thermal conduit, in which the heat sink is configured to dissipate heat from the heat generating device through the cover and the thermal conduit.

Figure 2:
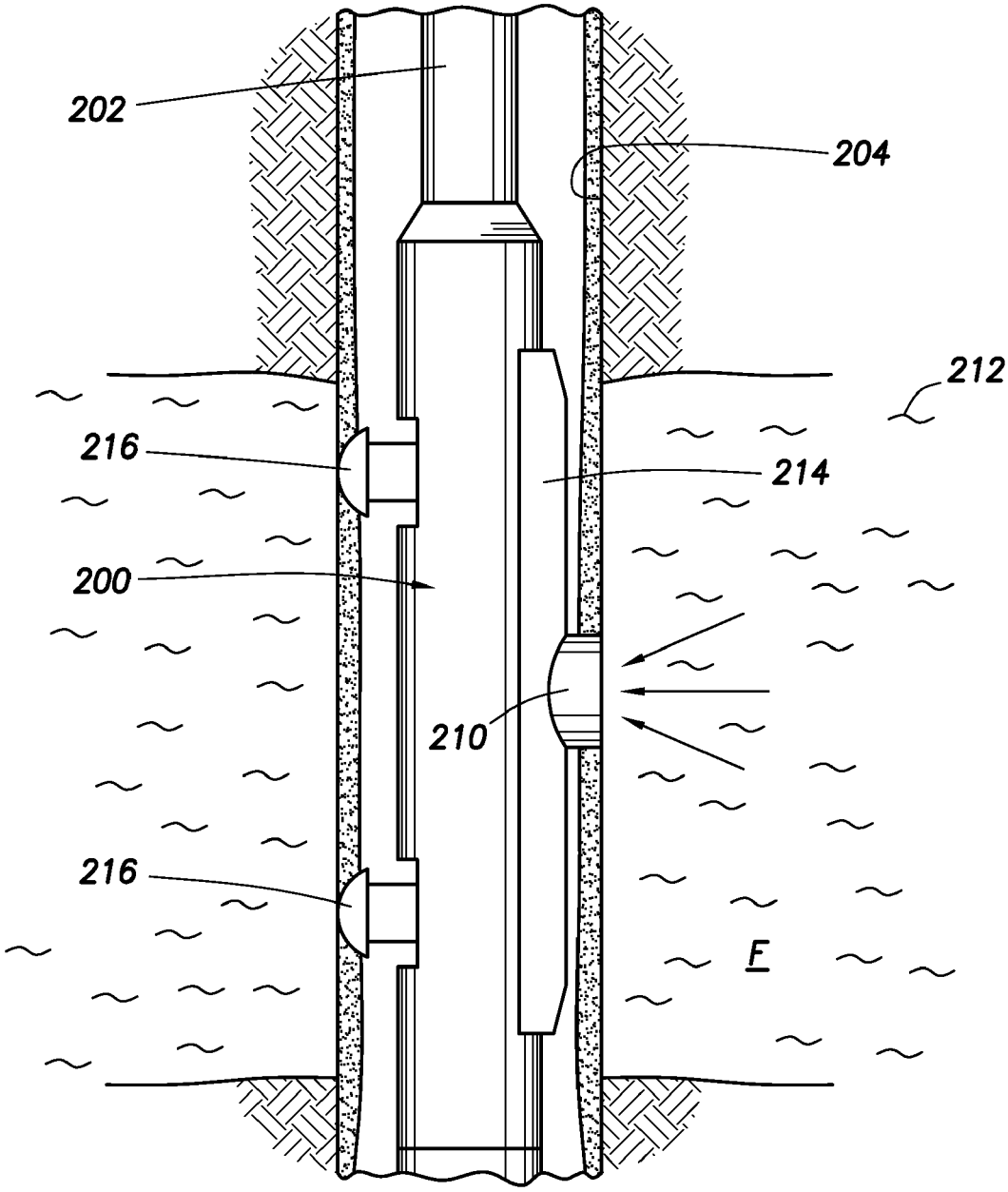
FIG. 2 shows a schematic view of a borehole having an apparatus in accordance with one or more aspects of the present disclosure.

Referring to FIG. 2, a schematic view of a borehole having a tool 200 in accordance with one or more embodiments of the present disclosure is shown. The tool 200 may be connected to and/or included within a drill string 202, in which the tool 200 may be disposed within a borehole 204 formed within a subsurface formation F. As such, the tool 200 may be included and used within a bottom hole assembly, as described above.

Particularly, in this embodiment, the tool 200 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. As such, the tool 200 may include a probe 210 to hydraulically establish communication with the formation F and draw formation fluid 212 into the tool 200.

In this embodiment, the tool 200 may also include a stabilizer blade 214 and/or one or more pistons 216. As such, the probe 210 may be disposed on the stabilizer blade 214 and extend therefrom to engage the wall of the borehole 204. The pistons, if present, may also extend from the tool 200 to assist probe 210 in engaging with the wall of the borehole 204. In alternative embodiments, though, the probe 210 may not necessarily engage the wall of the borehole 204 when drawing fluid.

As such, fluid 212 drawn into the tool 200 may be measured to determine one or more parameters of the formation F, such as pressure and/or pretest parameters of the formation F. Additionally, the tool 200 may include one or more devices, such as sample chambers or sample bottles, that may be used to collect formation fluid samples. These formation fluid samples may be retrieved back at the surface with the tool 200. Alternatively, rather than collecting formation fluid samples, the formation fluid 212 received within the tool 200 may be circulated back out into the formation F and/or borehole 204. As such, a pumping system may be included within the tool 200 to pump the formation fluid 212 circulating within the tool 200. For example, the pumping system may be used to pump formation fluid 212 from the probe 210 to the sample bottles and/or back into the formation F. Alternatively still, in one or more embodiments, rather than collecting formation fluid samples, a tool in accordance with embodiments disclosed herein may be used to collect samples from the formation F, such as one or more coring samples from the wall of the borehole 204.

The tool 200 may include a heat generating device, such as a an alternator configured to provide electric power to the tool 200, an electric motor configured to actuate a fluid pumping system provided with the tool 200, among other heat generating devices. As such, a heat dissipation apparatus in accordance with one or more embodiments of the present disclosure may be thermally coupled to the heat generating device. The heat dissipation apparatus may include one or more of a cover configured to attach to the heat generating device, a thermal conduit thermally coupled to the cover, and a heat sink thermally coupled to the thermal conduit, in which the heat sink is configured to dissipate heat from the heat generating device through the cover and the thermal conduit.

Figure 3:
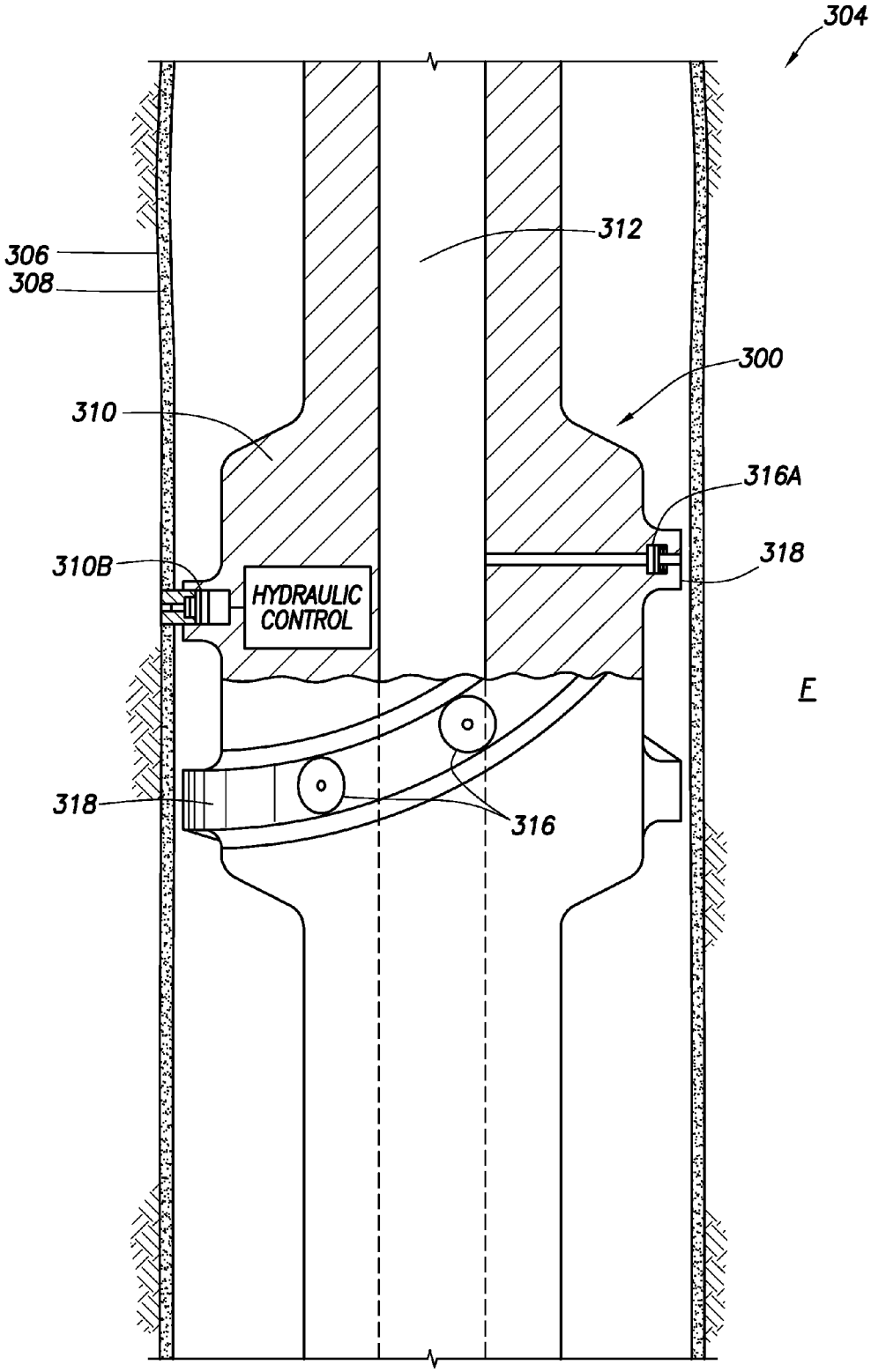
FIG. 3 shows a schematic view of a borehole having an apparatus in accordance with one or more aspects of the present disclosure.

Referring to FIG. 3, a schematic view of borehole having a tool 300 in accordance with one or more embodiments of the present disclosure is shown. The tool 300 may be connected to and/or included within a bottom hole assembly, in which the tool 300 may be disposed within a borehole 304 formed within a subsurface formation F.

In this embodiment, the tool 300 may be a pressure LWD tool used to measure one or more downhole pressures, including annular pressure, formation pressure, and pore pressure, before, during, and/or after a drilling operation. Further, those having ordinary skill in the art will appreciate that other pressure LWD tools may also be utilized in one or more embodiments, such as that described within U.S. Pat. No. 6,986,282, filed on Feb. 18, 2003, entitled "Method and Apparatus for Determining Downhole Pressures During a Drilling Operation," and incorporated herein by reference.

As shown, the tool 300 may be formed as a modified stabilizer collar 310, similar to a stabilizer collar as described above, and may have a passage 312 formed therethrough for drilling fluid. The flow of the drilling fluid through the tool 300 may create an internal pressure $P_1$, and the exterior of the tool 300 may be exposed to an annular pressure $P_A$ of the surrounding borehole 304 and formation F. A differential pressure $P_\delta$ formed between the internal pressure $P_1$ and the annular pressure $P_A$ may then be used to activate one or more pressure devices 316 included within the tool 300.

In this particular embodiment, the tool 300 includes two pressure measuring devices 316A and 316B that may be disposed on stabilizer blades 318 formed on the stabilizer collar 310. The pressure measuring device 316A may be used to measure the annular pressure $P_A$ in the borehole 304, and/or may be used to measure the pressure of the formation F when positioned in engagement with a wall 306 of the borehole 304. As shown in FIG. 3, the pressure measuring device 316A is not in engagement with the borehole wall 306, thereby enabling the pressure measuring device 316A to measure the annular pressure $P_A$, if desired. However, when the pressure measuring device 316A is moved into engagement with the borehole wall 306, the pressure measuring device 316A may be used to measure pore pressure of the formation F.

As also shown in FIG. 3, the pressure measuring device 316B may be extendable from the stabilizer blade 318, such as by using a hydraulic control disposed within the tool 300. When extended from the stabilizer blade 318, the pressure measuring device 316B may establish sealing engagement with the wall 306 of the borehole 304 and/or a mudcake 308 of the borehole 304. This may enable the pressure measuring device 316B to take measurements of the formation F also. Other controllers and circuitry, not shown, may be used to couple the pressure measuring devices 316 and/or other components of the tool 300 to a processor and/or a controller. This processor and/or controller may then be used to communicate the measurements from the tool 300 to other tools within a bottom hole assembly or to the surface of a wellsite. As such, a pumping system may be included within the tool 300, such as including the pumping system within one or more of the pressure devices 316 for activation and/or movement of the pressure devices 316.

The tool 300 may include a heat generating device, such as an alternator configured to provide electric power to the tool 300, an electric motor configured to actuate a fluid pumping system provided with the tool 300, among other heat generating devices. As such, a heat dissipation apparatus in accordance with one or more embodiments of the present disclosure may be thermally coupled to the heat generating device. The heat dissipation apparatus may include one or more of a cover configured to attach to the heat generating device, a thermal conduit thermally coupled to the cover, and a heat sink thermally coupled to the thermal conduit, in which the heat sink is configured to dissipate heat from the heat generating device through the cover and the thermal conduit.

Figure 4:
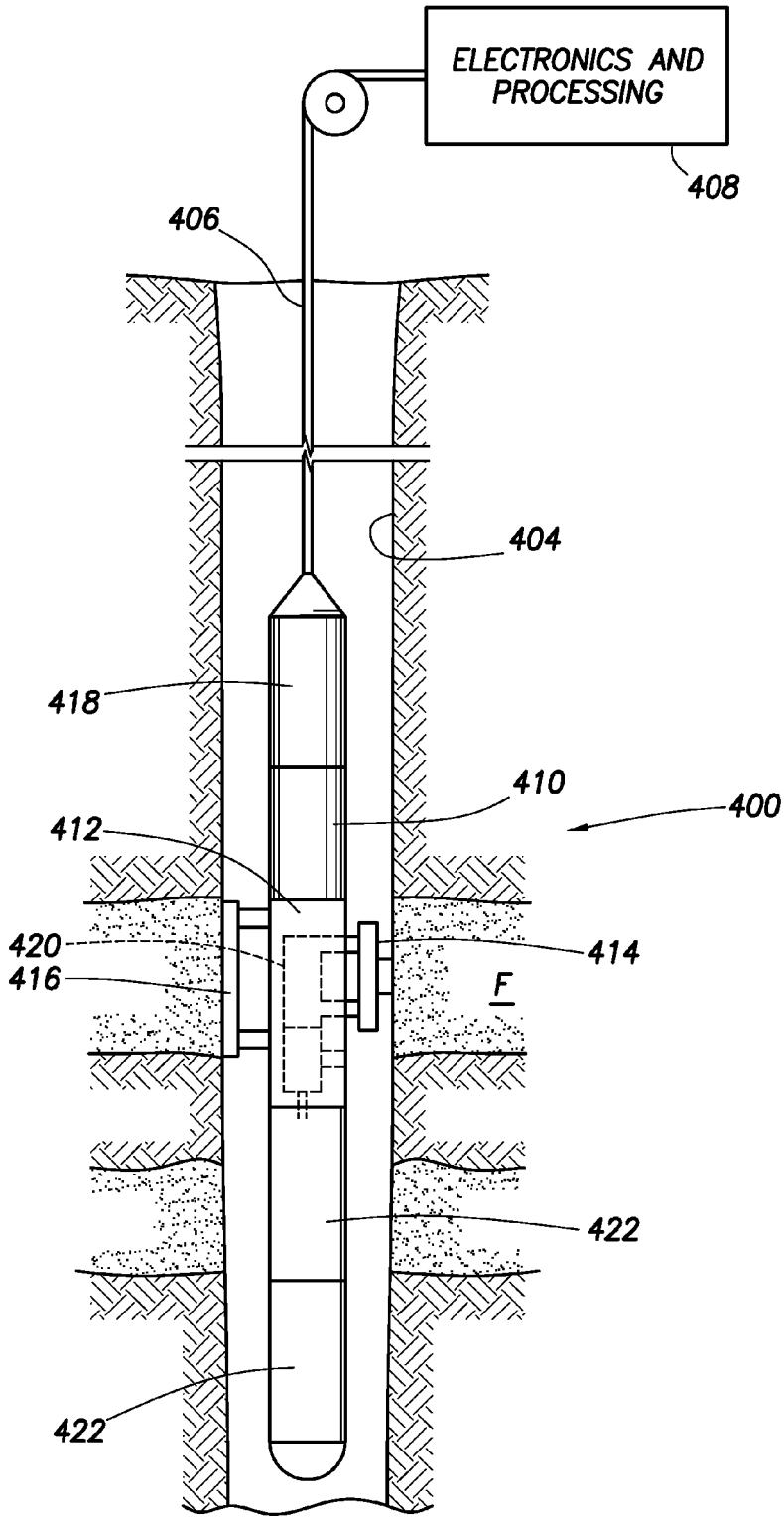
FIG. 4 shows a schematic view of a wellsite having an apparatus in accordance with one or more aspects of the present disclosure.

Referring to FIG. 4, a schematic view of a wellsite having a tool 400 in accordance with one or more embodiments of the present disclosure is shown. In this embodiment, the tool 400 may be a "wireline" tool, in which the tool 400 may be suspended within a borehole 404 formed within a subsurface formation F. As such, the tool 400 may be suspended from an end of a multi-conductor cable 406 located at the surface of the formation F, such as by having the multi-conductor cable 406 spooled around a winch (not shown) provided in a truck (not shown) disposed at the surface of the formation F. The multi-conductor cable 406 is then coupled the tool 400 with an electronics and processing system 408 disposed on the surface.

The tool 400 shown in this embodiment may have an elongated body 410 that includes a formation tester 412 disposed therein. The formation tester 412 may include an extendable probe 414 and an extendable anchoring member 416, in which the probe 414 and anchoring member 416 may be disposed on opposite sides of the body 410. One or more other components 418, such as a measuring device, may also be included within the tool 400.

The probe 414 may be included within the tool 400 such that the probe 414 may be able to extend from the body 410 and then selectively seal off and/or isolate selected portions of the wall of the borehole 404. This may enable the probe 414 to establish pressure and/or fluid communication with the formation F to draw fluid samples from the formation F. The tool 400 may also include a fluid analysis tester 420 that is in fluid communication with the probe 414, thereby enabling the fluid analysis tester 420 to measure one or more properties of the fluid. The fluid from the probe 414 may also be sent to one or more sample chambers or bottles 422, which may receive and retain fluids obtained from the formation F for subsequent testing after being received at the surface. The fluid from the probe 414 may also be sent back out into the borehole 404 or formation F.

The tool 400 may include a heat generating device, such as power electronics configured to transform the electric energy provided by the multi-conductor cable 406, an electric motor configured to actuate a fluid pumping system provided with the tool 400, among other heat generating devices. As such, a heat dissipation apparatus in accordance with one or more embodiments of the present disclosure may be thermally coupled to the heat generating device. The heat dissipation apparatus may include one or more of a cover configured to attach to the heat generating device, a thermal conduit thermally coupled to the cover, and a heat sink thermally coupled to the thermal conduit, in which the heat sink is configured to dissipate heat from the heat generating device through the cover and the thermal conduit.

Figure 5:
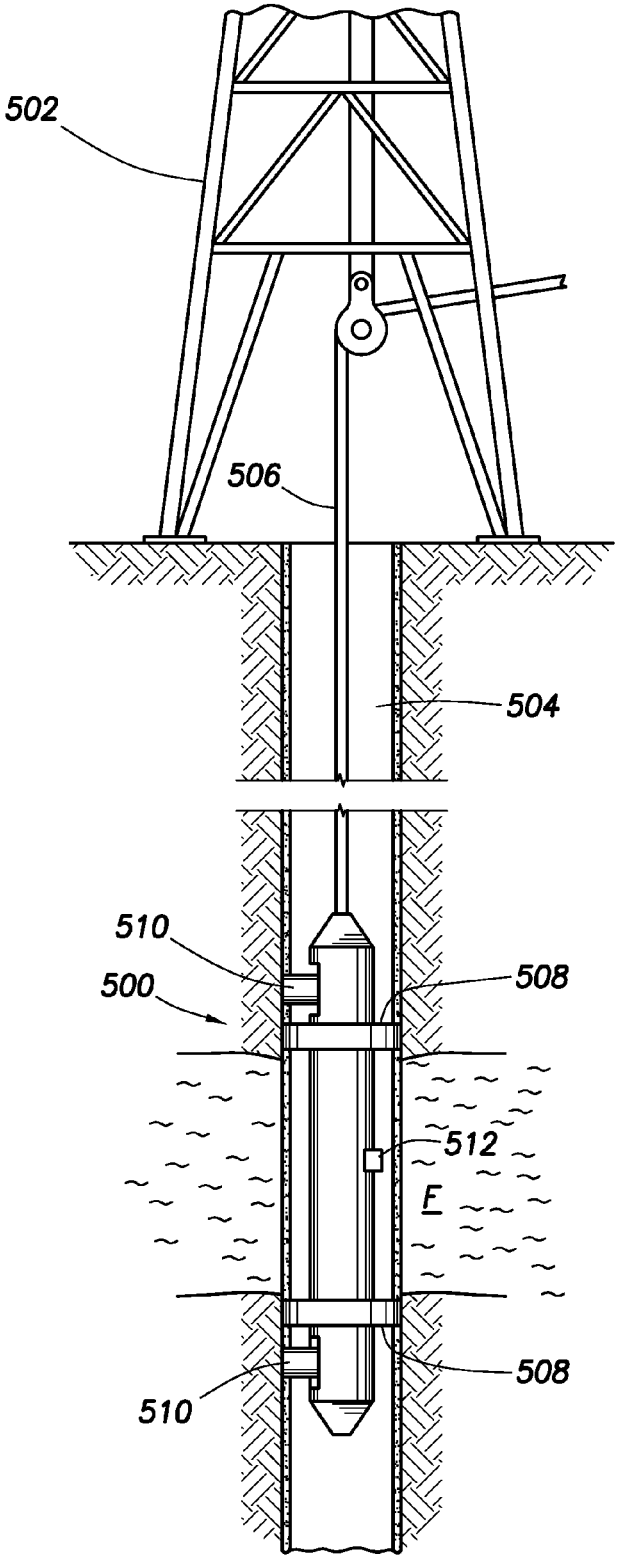
FIG. 5 shows a schematic view of a wellsite having an apparatus in accordance with one or more aspects of the present disclosure.

Referring to FIG. 5, a schematic view of a wellsite having a tool 500 in accordance with one or more embodiments of the present disclosure is shown. Similar to the above embodiment in FIG. 4, the tool 500 may be suspended within a borehole 504 formed within a subsurface formation F using a multi-conductor cable 506. In this embodiment, the multi-conductor cable 506 may be supported by a drilling rig 502.

As shown in this embodiment, the tool 500 may include one or more packers 508 that may be configured to inflate, thereby selectively sealing off a portion of the borehole 504 for the tool 500. Further, to test the formation F, the tool 500 may include one or more probes 510, and the tool 500 may also include one or more outlets 512 that may be used to inject fluids within the sealed portion established by the packers 508 between the tool 500 and the formation F.

The tool 500 may include a heat generating device, such as power electronics configured to transform the electric energy provided by the multi-conductor cable 506, an electric motor configured to actuate a fluid pumping system provided with the tool 500, among other heat generating devices. As such, a heat dissipation apparatus in accordance with one or more embodiments of the present disclosure may be thermally coupled to the heat generating device. The heat dissipation apparatus may include one or more of a cover configured to attach to the heat generating device, a thermal conduit thermally coupled to the cover, and a heat sink thermally coupled to the thermal conduit, in which the heat sink is configured to dissipate heat from the heat generating device through the cover and the thermal conduit.

Figure 6:
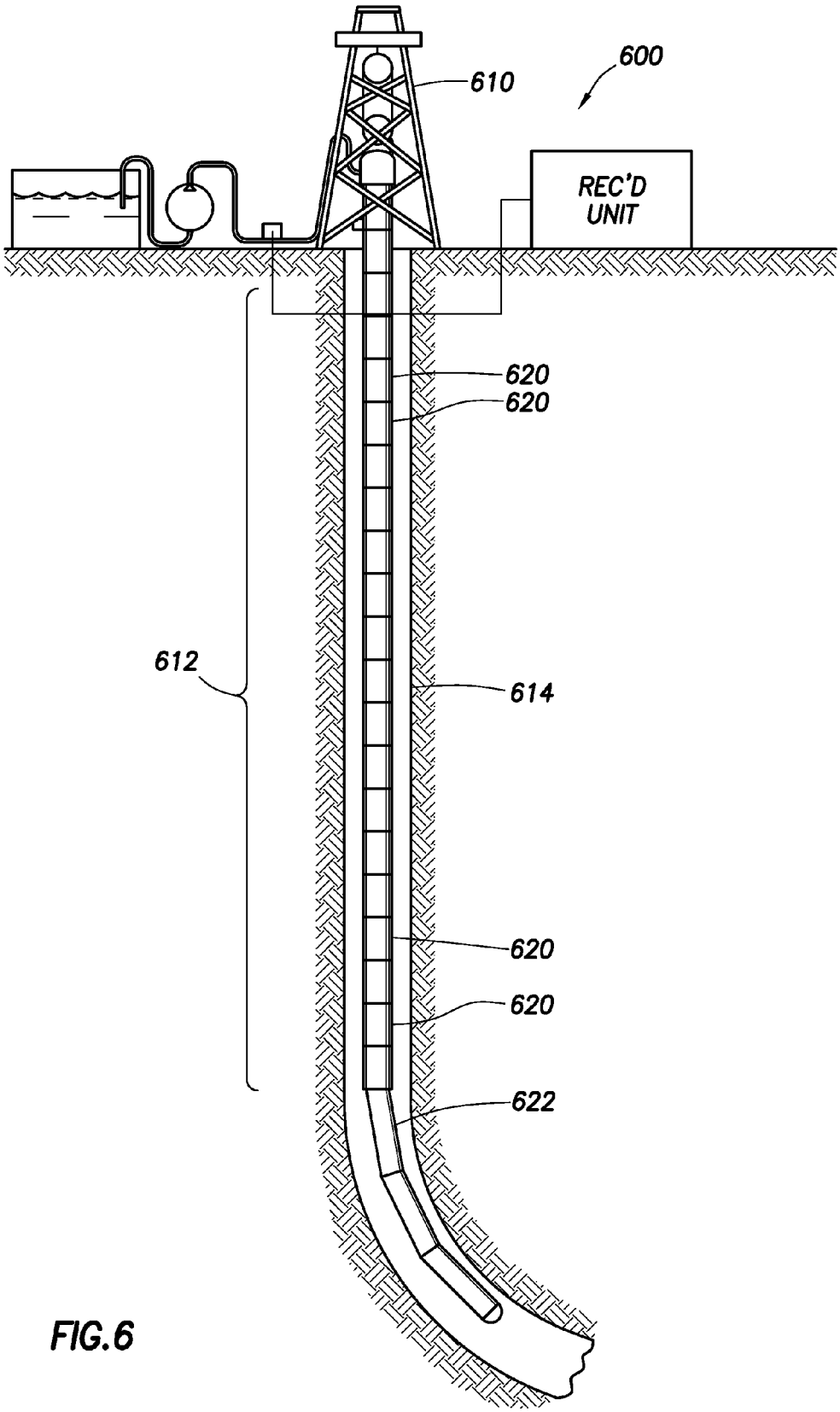
FIG. 6 shows a schematic view of a wellsite having an apparatus in accordance with one or more aspects of the present disclosure.

Referring to FIG. 6, a schematic view of a wellsite 600 having a drilling rig 610 in accordance with one or more embodiments of the present disclosure is shown. In this embodiment, a borehole 614 may be formed within a subsurface formation F, such as by using a drilling assembly, or any other method known in the art. Further, in this embodiment, a wired pipe string 612 may be suspended from the drilling rig 610. The wired pipe string 612 may be extended into the borehole 614 by threadably coupling multiple segments 620 (i.e., joints) of wired drill pipe together in an end-to-end fashion. As such, the wired drill pipe segments 620 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. Further, the wired drill pipe may include having a form of signal coupling, such as having inductive coupling, to communicate data and/or signals between adjacent pipe segments assembled together.

As such, the wired pipe string 612 may include one or more tools 622 and/or instruments disposed within the pipe string 612. For example, as shown in FIG. 6, a string of multiple borehole tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation F.

The tools 622 may be connected to the wired pipe string 612 during drilling the borehole 614, or, if desired, the tools 622 may be installed after drilling the borehole 614. If installed after drilling the borehole 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the borehole 614. The tools 622 may then be positioned within the borehole 614, as desired, through the selective movement of the wired pipe string 612, in which the tools 622 may gather measurements and data. These measurements and data from the tools 622 may then be transmitted to the surface of the borehole 614 using the cable within the wired drill pipe 612.

One or more of the tools 622 may include a heat generating device, such as an alternator configured to provide electric power to the tools 622, a pulsed neutron generator, among other heat generating devices. As such, a heat dissipation apparatus in accordance with one or more embodiments of the present disclosure may be thermally coupled to the heat generating device. The heat dissipation apparatus may include one or more of a cover configured to attach to the heat generating device, a thermal conduit thermally coupled to the cover, and a heat sink thermally coupled to the thermal conduit, in which the heat sink is configured to dissipate heat from the heat generating device through the cover and the thermal conduit.

As such, a heat dissipation device and/or apparatus may be included within one or more of the embodiments shown in FIGS. 1-6, in addition to being included within other tools and/or devices that may be disposed downhole within a formation. A heat dissipation device, thus, may be used to dissipate heat from heat generating devices and/or elements of a downhole tool, thereby maintaining, or assisting to maintain, sustainable operation temperatures for downhole devices and/or elements. The heat dissipation device may be disposed on a tool body and may include one or more heat sinks, thermal conduits, heat pipes, support structures, biasing mechanisms, covers, and/or other elements and/or components, or combinations thereof. Further, thermal coupling surfaces and/or elements may employ the use of a thermally conductive material, such as a thermal gel, paste, grease, and/or other thermally conductive substance therebetween, for example, on contact surfaces between the thermal units.

According to one or more embodiments disclosed herein, a heat dissipation device may be thermally coupled to heat generating devices and/or elements. More particularly, a heat generating device may be thermally coupled to a heat sink by thermal conduits. As used herein, thermally coupled may mean to be coupled and/or in contact such that heat may be transferred from a first element to a second element, and the thermal coupling may include a thermally conductive material applied therebetween, such as thermal paste (or other compound), as noted above. Furthermore, a heat sink may be biased along a longitudinal axis of the downhole tool. Heat sinks, in accordance with one or more embodiments of the present disclosure, may be made of aluminum, copper, or other metals and/or materials which may provide a high thermal conductivity, high thermal capacity, high thermal diffusivity, and/or a higher rate of thermal transfer. Furthermore, thermal conduits may be made of the same and/or similar material as that of the heat sink.

A heat dissipation device, in accordance with one or more embodiments of the present disclosure, may thermally couple a heat generating device with a housing of the downhole tool in which the heat generating device may be located. A housing of the downhole tool may have a larger heat capacity, thereby allowing heat from a heat generating device to be transferred to the housing, the borehole fluid contacting the housing, and/or a portion of the formation adjacent to the housing, thereby possibly allowing the heat generating device to maintain an operating temperature and/or preventing an overheating of the heat generating device or damage thereto. Accordingly, a heat sink of the heat dissipation device may be thermally coupled with the housing of the downhole tool.

To dissipate the heat generated by the heat generating device from the heat generating device to the housing of the downhole tool, thermal conduits may be employed. One or more thermal conduits may be thermally coupled to the heat generating device such that heat generated by the heat generating device may be transferred from the heat generating device into and/or through the thermal conduits. The thermal conduit may be at least partially located within a cover that may be thermally conductive. The thermal conduit may further be thermally coupled to one or more heat sinks, such that the heat in the thermal conduits may be transferred into and/or through the heat sink Furthermore, the heat sink may be thermally coupled to a housing of the downhole tool such that heat within the heat sink may be thermally transferred to the housing of the downhole tool.

Moreover, in accordance with one or more embodiments of the present disclosure, a heat sink may be moveable with respect to the downhole tool. Furthermore, the heat generating device(s) may be attached to, or contained on and/or in, a chassis movable within the downhole tool housing, such as an electronics chassis. The heat sink may, therefore, also be moveable with respect to the chassis. Accordingly, a heat sink may be attached to and/or coupled to the chassis and/or heat generating device(s). The heat sink may be coupled to the heat generating device(s) by thermal conduits, or directly coupled thereto, and the heat sink may be coupled and/or attached to the chassis by a support structure. The support structure may provide a stopper and/or base upon which the heat sink may be placed and/or biased. The support structure may be a clamp, block, ledge, and/or other structure that may support and/or provide a surface against which the heat sink may be biased. A biasing mechanism may be placed between the support structure and the heat sink such that the heat sink may be biased against and/or with respect to the support structure. Further, the support structure may be rigidly attached to the chassis and/or the housing of the downhole tool.

The biasing mechanism may allow for the heat sink to be moveable within the downhole tool and the heat sink may be, at least partially, rotatable with respect to an axis of the downhole tool. Accordingly, the biasing mechanism may allow the heat sink to be movable and/or rotatable. Specifically, the heat sink may be able to move axially with respect to an axis of the downhole tool. The heat sink may also be rotatable about the axis of the downhole tool. For example, the heat sink may be able to tilt with respect to the axis of the downhole tool. Accordingly, the heat sink may have three or more freedoms of movement with respect to the axis of the downhole tool.

Furthermore, one or more embodiments of the present disclosure may include both thermal conduits and biased heat sinks. Accordingly, a heat sink may be thermally coupled to a heat generating device(s) through thermal conduits and may further be biased with respect to a chassis upon which the heat generating device(s) may be attached and/or with respect to a housing of the downhole tool.

A heat sink in accordance with one or more embodiments of the present disclosure may further provide a physical and/or thermal contact with a housing of a downhole tool that the heat sink may be placed into. As such, a surface of the heat sink may be tapered such that the heat sink may mate and/or engage with a corresponding mating surface of the downhole tool. In one or more embodiments of the present disclosure, the engagement of the heat sink with an interior surface of the downhole tool may prevent a cover, which may hold and/or contain any thermal conduits and/or heat generating devices, from contacting an inner surface of the downhole tool. Accordingly, the tapered surface of the heat sink may be the only surface of the heat dissipation device that may be in contact with an inner surface of a downhole tool.

Figure 7:
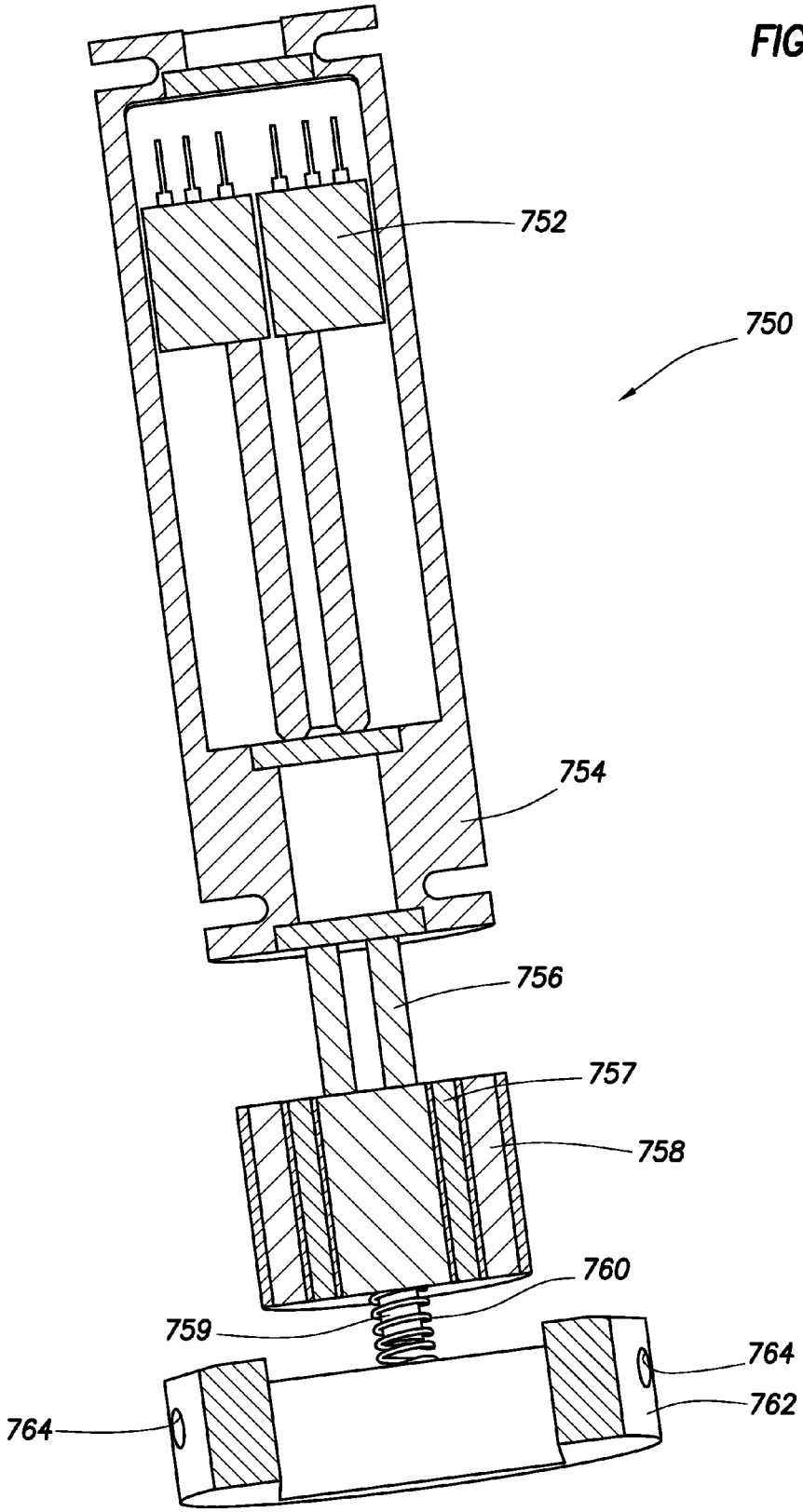
FIG. 7 shows a schematic view of an apparatus in accordance with one or more aspects of the present disclosure.

Referring to FIG. 7, a schematic view of a heat dissipation apparatus, or device, 750 in accordance with one or more embodiments of the present disclosure is shown. Heat dissipation device 750 may include one or more heat generating devices 752. Heat generating devices 752 may include electronics devices and/or any other heat generating elements, tools, and/or equipment that may be used in a downhole tool. Heat generating devices 752 may be contained in and/or coupled to a cover 754 that may be made of a material with a high thermal conductivity, such that the cover may serve as a heat transfer element of the heat dissipation device 750. Cover 754 may also include one or more thermal conduits 756, which may be thermally coupled to heat generating device 752. Thermal paste (or other compound) may be applied between cover 754, heat generating device 752, and/or thermal conduits 756, as described above. Thermal conduit 756 may include heat pipes or other heat transferring elements, such that heat from heat generating device 752 may be transferred into and/or through thermal conduit 756. Although shown as two heat pipes, thermal conduit 756 may be any number of thermal pipes and/or thermally conducting elements and may be made of a material with a high thermal conductivity, such as the same, similar, or different from, the material that cover 754 may be made. Further, thermal conduit 756 may be loosely engaged with an interior of cover 754, or may be rigidly attached thereto.

Thermal conduit 756 may also be thermally coupled to one or more heat sinks 758. Heat sink 758 may be made of a material having a high thermal conductivity, such as the same, similar, or different from, the materials of cover 754 and/or thermal conduit 756. Thermal conduit 756 may be rigidly engaged with heat sink 758, or may be freely moveable with respect to heat sink 758, while maintaining thermal coupling with heat sink 758. Accordingly, thermal conduit 756 may be soldered to, welded to, bonded to, screwed into, made of a continuous element, mold formed, and/or other rigid connection with heat sink 758. Alternatively, thermal conduit 756 may be free to move within and/or against heat sink 758 and thermal paste (or other compound) may be applied therebetween, as described above. Thus, thermal conduit 756 may be placed within a hole and/or receiving portion of heat sink 758 such that an end of thermal conduit 756 may sit within the hole and/or receiving portion of heat sink 758. Alternatively, thermal conduit 756 may be biased with respect to heat sink 758. For example, a coil spring may hold thermal conduit 756 in thermal coupling with heat sink 758.

Heat sink 758 may be shaped so as to engage with a part or parts of a downhole tool. For example, heat sink 758 may include rails 757 (on an interior surface), which may allow for engagement with a surface that may be in contact with heat sink 758. Further, heat sink 758 may have another surface (e.g., an exterior surface, not shown) that may be tapered so as to engage with another tapered or mating surface (described more below).

Referring still to FIG. 7, heat sink 758 may be biased with respect to, and/or attached to, a support structure 762. The attachment and or biasing may be provided by a biasing mechanism 760. Although shown as a coiled spring, biasing mechanism 760 may be any biasing mechanism known in the art including, but not limited to, rubber and elastomeric spring members. Biasing mechanism 760 may freely sit within holes or receiving portions of heat sink 758 and/or support structure 762. Alternatively, biasing mechanism 760 may be rigidly attached to heat sink 758 and/or support structure 762 by soldering, welding, bonding, and/or any other rigidly attaching means. Furthermore, biasing mechanism 760 may be rigidly attached to heat sink 758 or support structure 762 and freely engaged with the other element, heat sink 758 or support structure 762. Accordingly, heat sink 758 and/or support structure 762 may include a guide mechanism 759, if desired, such that biasing mechanism 760 may attach and/or engage with the support structure 762 and/or heat sink 758. For example, as shown in FIG. 7, heat sink 758 may include a guide mechanism 759, such as a peg, that biasing mechanism 760 may be placed over. Support structure 762 may also or alternatively include a guide mechanism 759.

Support structure 762 may be formed and/or shaped so as to engage with and/or attach to a chassis or other element of a downhole tool. Accordingly, as shown in FIG. 7, support structure 762 may be "U" or "C" shaped, such that support structure 762 may fit around and/or attach to a chassis. Alternatively, support structure 762 may take any shape, including an "O" or a square shape, or may be a single flat element, or any other shape such that the support structure 762 may engage with a chassis or other downhole tool or element. Support structure 762 may attach to a chassis by screws, glue, clips, pressure engagement, and/or any other engagement means known in the art. For example, support structure 762 may include holes 764 that may allow screws, bolts, or other elements to be placed therethrough and engage with a chassis that the heat dissipation device 750 may be attached to.

Figure 8:
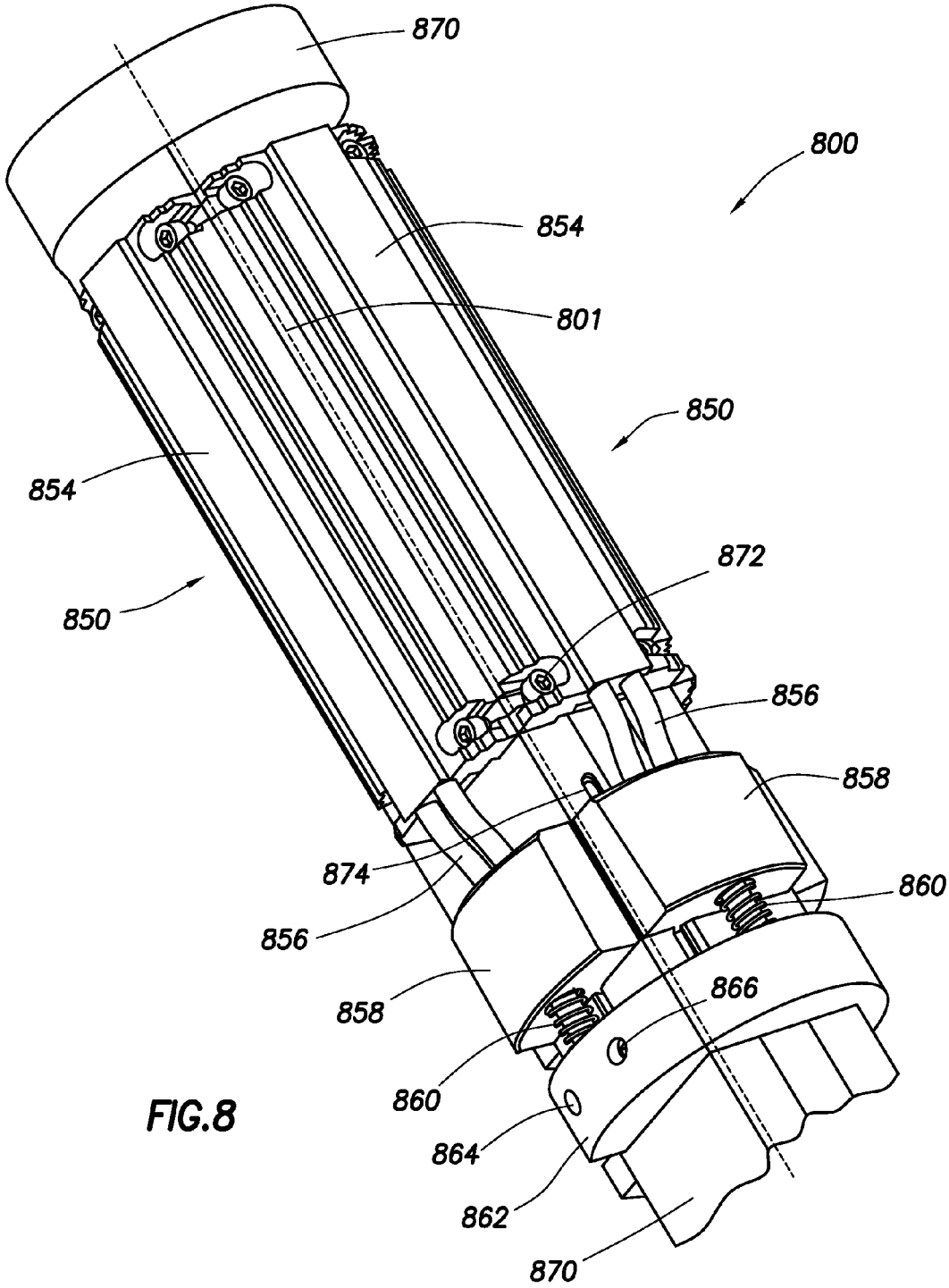
FIG. 8 shows a schematic view of an apparatus in accordance with one or more aspects of the present disclosure.

Now referring to FIG. 8, a schematic view of a downhole tool 800 in accordance with one or more embodiments of the present disclosure is shown. Downhole tool 800 may have an axis 801 (dashed line) and may include a chassis 870, which may be, for example, an electronics chassis or insert. Chassis 870 may include and/or house electronic devices and/or elements (not explicitly visible) of downhole tool 800. As shown in FIG. 8, downhole tool 800 may be configured to hold and/or support more than one heat dissipation device 850. Accordingly, multiple covers 854 may be attached to chassis 870. Covers 854 may be rigidly attached to chassis 870 by screws, bolts, glue, and/or any other engaging device, mechanism, or method known in the art. As shown in FIG. 8, covers 854 may be attached to chassis 870 by socket head cap screws 872.

Thermal conduits 856 may run within and/or through covers 854. Further, thermal conduits 856 may be engaged with, and thermally coupled to, heat sinks 858. Heat sinks 858 may be engaged with chassis 870 by tracks 874. For example, the rails, described above, of heat sinks 858 may engage with and/or correspond to tracks 874 of chassis 870. The rails and tracks 874 may assist heat sinks 858 in axial movement with respect to chassis 870 along axis 801. However, those having ordinary skill in the art will appreciate that other structures, mechanisms, and/or methods may be used to engage heat sink 858 with chassis 870.

Heat sinks 858 may further be engaged with support structure 862. As shown, support structure 862 may support one or more heat sinks 858. Heat sinks 858 may engage with support structure 862 using one or more biasing mechanisms 860, as described above. Support structure 862 may be rigidly attached to chassis 870 by attachment mechanisms, as described above. For example, screws or bolts 866 may be inserted through holes 864 and may threadably engage with chassis 870.

Biasing mechanisms 860 may allow for heat sinks 858 to be moveable and/or, at least partially, rotatable with respect to chassis 870 along, about, and/or with respect to axis 801. Accordingly, biasing mechanisms 860 may allow heat sinks 858 to be movable and/or rotatable with respect to axis 801. Specifically, heat sinks 858 may be able to move axially, as described above, with respect to axis 801. Heat sinks 858 may also be rotatable about axis 801. For example, heat sinks 858 may be able to tilt with respect to axis 801. Accordingly, heat sinks 858 may have at least three freedoms of movement with respect to axis 801.

Figure 9:
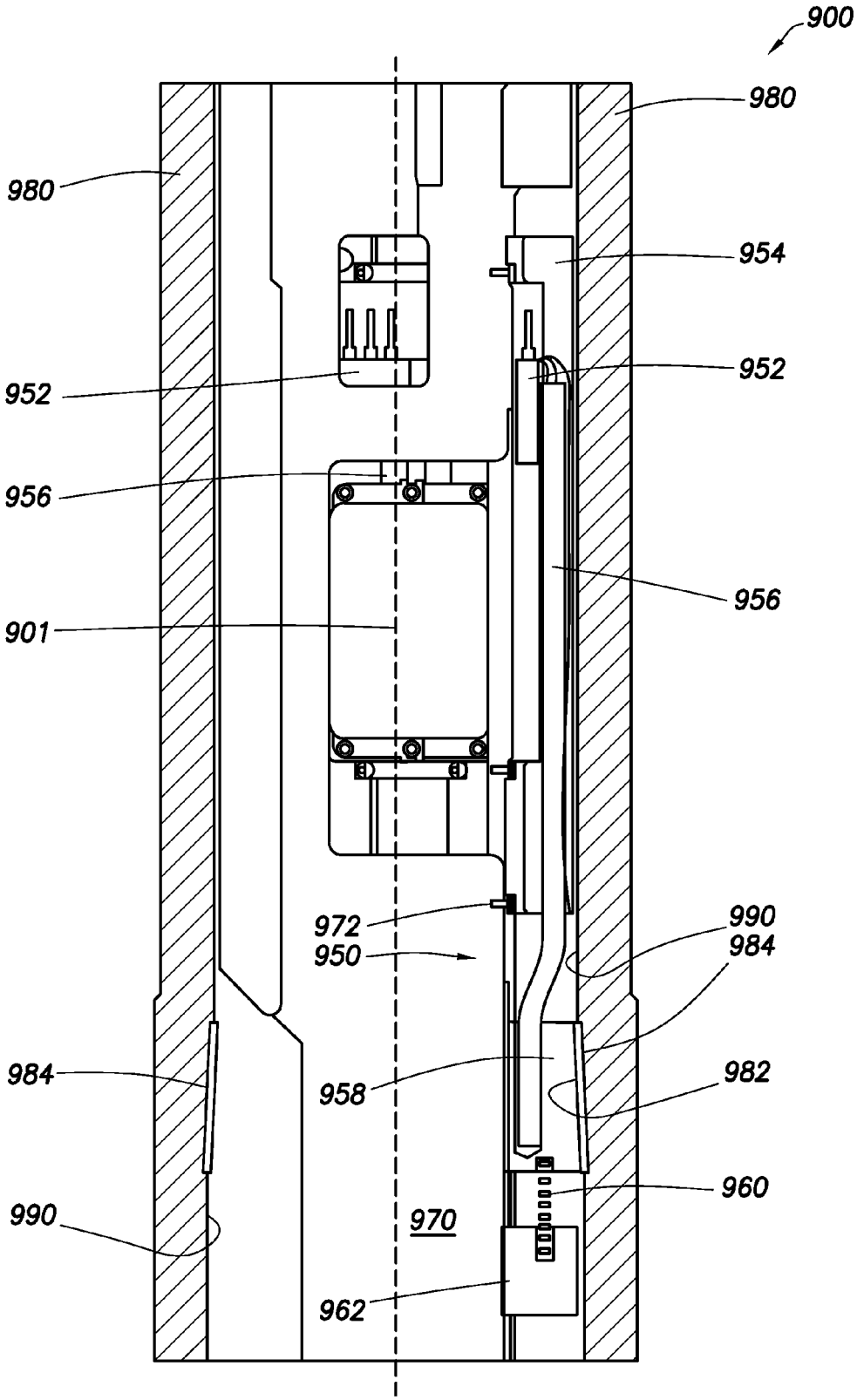
FIG. 9 shows a schematic view of an apparatus in accordance with one or more aspects of the present disclosure.

Referring to FIG. 9, a schematic view of a heat dissipation device 950 in accordance with one or more embodiments of the present disclosure is shown. A downhole tool 900 may include heat dissipation device 950. Heat dissipation device 950 may be thermally coupled to heat generating device 952, and configured to dissipate heat through thermal conduits 956 and heat sink 958 and into housing 980 of downhole tool 900.

Heat dissipation device 950 may include thermal conduits 956 and heat sink 958, as discussed above, and thermal paste (or other compound) may be applied therebetween, as described above. Further, heat sink 958 may be biased against and with respect to a support structure 962 by a biasing mechanism 960, as discussed above.

Further, heat sink 958 may have an exterior tapered mating surface 982. Tapered mating surface 982 of heat sink 958 may be configured to engage with a tapered mating portion 984 of housing 980. Accordingly, tapered mating surface 982 of heat sink 958 may engage with and physically contact tapered mating portion 984 of housing 980. The engagement of tapered mating surface 982 and tapered mating portion 984 may allow heat dissipation device 950 to sit appropriately within housing 980. Further, as heat sink 958 may be biased with respect to support structure 962 by biasing mechanism 960, heat sink 958 may be freely moveable until heat sink 958 is fully engaged with tapered mating portion 984 of housing 980. Therefore, the inclined surfaces of tapered mating surface 982 and tapered mating portion 984 may allow for a pressure engagement between heat dissipation device 950 and housing 980.

Biasing mechanism 960 may allow for heat sink 958 to be moveable and/or, at least partially, rotatable with respect to chassis 970 along, about, and/or with respect to axis 901. Accordingly, biasing mechanism 960 may allow heat sink 958 to be movable and/or rotatable with respect to axis 801. Specifically, heat sink 958 may be able to move axially, as described above, with respect to axis 801. Heat sink 958 may also be rotatable about axis 801. For example, heat sink 958 may be able to tilt with respect to axis 801. Accordingly, heat sink 958 may have three or more freedoms of movement with respect to axis 801.

Further, in the embodiment shown in FIG. 9, tapered mating surface 982 of heat sink 958 may be the only surface of heat dissipation device 950 that may contact an interior surface 990 of housing 980. Specifically, tapered mating surface 982 of heat sink 958 may extend to a radial position, with respect to a longitudinal axis 901 of the downhole tool 900, that may be larger than a radial position of cover 954 and/or any other element of heat dissipation device 950. Therefore, no contact may be established between a downhole tool 900 and a housing of the downhole tool 980, until contact is established between tapered mating surface 982 and tapered mating portion 984. Accordingly, a thermal paste (or other compound, e.g., anti-size compound) that may applied to tapered mating surface 958 of heat sink 959 may not be scraped off of the surface during insertion of downhole tool 900 into housing 980.

Accordingly, embodiments disclosed herein may provide for one or more of the following advantages. A tool and/or a method in accordance with the present disclosure may be included within one or more of the embodiments shown in FIGS. 1-6, in addition to being included within other tools and/or devices that may be disposed downhole within a formation. Further, a tool and/or a method in accordance with one or more embodiments of the present disclosure may be able to dissipate heat from heat generating devices within a downhole tool efficiently.

Therefore, in accordance with one or more embodiments of the present disclosure, a heat dissipation device may be employed with one or more heat generating devices of a downhole tool. Advantageously, a heat sink may be biased within a downhole tool such that the heat sink may move freely within the downhole tool prior to engagement and operation. Accordingly, a heat sink in accordance with one or more embodiments of the present disclosure may be able to properly engage with an interior surface of a housing of a downhole tool such that a proper thermal coupling may be established between the heat sink and the housing.

Further, in accordance with one or more embodiments of the present disclosure, a heat sink may include a tapered surface that may be configured to engage with an interior surface of a housing of a downhole tool. Accordingly, a proper thermal coupling may be established between the heat sink and the housing.

Further, in accordance with one or more embodiments of the present disclosure, a heat sink may include a tapered surface such that the tapered surface may be the only surface of a downhole tool that may contact and/or engage with a housing of the downhole tool. Accordingly, any thermal paste (or other compound) that may be applied to a surface of the heat sink and/or surface of the housing may not be removed or scraped away during insertion of the downhole tool into the housing.

Further, in accordance with one or more embodiments of the present disclosure, a heat generating device may be thermally coupled to a heat sink by means of a thermal conduit. Accordingly, the shape and/or size and/or configuration of a downhole tool may be modified to a particular means, without mounting a heat sink directly to heat generating devices. Furthermore, the thermal conduits may allow for the heat sink to be freely moveable within a downhole tool and the heat sink may be freely moveable with respect to an axis of the downhole tool.

Further, in accordance with one or more embodiments of the present disclosure, thermal conduits may be freely moveable within a downhole tool. Specifically, thermal conduits may be freely moveable within a cover that may house the thermal conduits and/or heat generating devices, and, further, the thermal conduits may be freely moveable within and/or with respect to a heat sink. Additionally, although freely moveable, the thermal conduits may be thermally coupled to the heat generating devices and/or heat sink.

Further, in accordance with one or more embodiments of the present disclosure, a cover, thermal conduits, a heat sink, and a housing of a downhole tool may be configured to transfer heat away from heat generating devices, such that overheating of the heat generating devices may be avoided.

In accordance with one aspect of the present disclosure, one or more embodiments disclosed herein relate to a heat dissipation apparatus to be used within a downhole tool. The heat dissipation apparatus may include a cover configured to attach to a heat generating device, a thermal conduit thermally coupled to the cover, and a heat sink thermally coupled to the thermal conduit, in which the heat sink is configured to dissipate heat from the heat generating device through the cover and the thermal conduit.

In accordance with another aspect of the present disclosure, one or more embodiments disclosed herein relate to a heat dissipation apparatus to be used within a downhole tool. The heat dissipation apparatus may include a cover configured to attach to the heat generating device, a heat sink thermally coupled to the heat generating device, a support structure configured to attach to a body of the downhole tool, and a biasing mechanism disposed between the heat sink and the support structure such that the biasing mechanism biases the heat sink in a direction along an axis of the downhole tool.

In accordance with another aspect of the present disclosure, one or more embodiments disclosed herein relate to a method dissipate heat to be used within a downhole tool. The method may include disposing a cover configured to attach to a heat generating device in the downhole tool, and thermally coupling the cover and a heat sink with a thermal conduit, in which the heat sink is configured to dissipate heat from the heat generating device through the cover and the thermal conduit.

In accordance with another aspect of the present disclosure, one or more embodiments disclosed herein relate to a method to dissipate heat to be used within a downhole tool. The method may include disposing a cover configured to attach to a heat generating device in the downhole tool, thermally coupling a heat sink to the heat generating device, attaching a support structure to a body of the downhole tool, and biasing the heat sink against the support structure such that the heat sink is biased along an axis of the downhole tool.

In accordance with another aspect of the present disclosure, one or more embodiments disclosed herein relate to an apparatus comprising a downhole tool configured to suspend in a borehole penetrating a subterranean formation. The downhole tool may comprise a housing having an interior surface with a tapered mating portion, and a heat sink thermally coupled to a heat generating device comprising a tapered mating surface, wherein the tapered mating portion of the housing is configured to engage with the tapered mating surface of the heat sink.

In accordance with another aspect of the present disclosure, one or more embodiments disclosed herein relate to an apparatus comprising a downhole tool configured to suspend in a borehole penetrating a subterranean formation, the downhole tool comprising a heat sink thermally coupled to a heat generating device a support structure configured to secure to a body of the downhole tool, and a biasing mechanism coupled to the heat sink and the support structure and configured to bias the heat sink in a direction along a longitudinal axis of the downhole tool.

In accordance with another aspect of the present disclosure, one or more embodiments disclosed herein relate to an apparatus comprising a tool to be disposed downhole within a borehole, the tool comprising a housing having an interior surface with a tapered mating portion, a heat sink disposed thermally coupled to a heat generating device and comprising a tapered mating surface, wherein the tapered mating portion of the heat sink is configured to engage with the tapered mating surface of the housing, and a biasing mechanism engaged with the chassis and the heat sink and configured to bias the heat sink in a direction along a longitudinal axis of the tool, wherein the heat sink is configured to dissipate heat from the heat generating device.

The foregoing outlines feature several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool configured for conveyance within a borehole penetrating a subterranean formation, the downhole tool comprising:

a housing having an interior surface with a tapered mating portion; and a heat sink thermally coupled to a heat generating device comprising a tapered mating surface;

wherein the tapered mating portion of the housing is configured to engage with the tapered mating surface of the heat sink.

2. The apparatus of claim 1 wherein the heat sink is configured to rotate, at least partially, with respect to the housing of the downhole tool.

3. The apparatus of claim 1 further comprising a cover, wherein the cover is configured to dissipate heat from the heat generating device.

4. The apparatus of claim 1 further comprising a thermal conduit thermally coupled to the heat generating device, wherein the heat sink is configured to dissipate heat from the heat generating device through the thermal conduit.

5. The apparatus of claim 4, wherein the thermal conduit comprises at least one heat pipe.

6. The apparatus of claim 1 further comprising a thermal conduit thermally coupled to the heat sink, wherein the thermal conduit is moveably engaged with an interior of the heat sink.

7. The apparatus of claim 6, wherein the thermal conduit comprises at least one heat pipe.

8. An apparatus, comprising:

a downhole tool configured to suspend in a borehole penetrating a subterranean formation, the downhole tool comprising:

a heat sink thermally coupled to a heat generating device;

a support structure configured to secure to a body of the downhole tool, wherein the body of the downhole tool comprises a movable chassis; and a biasing mechanism coupled to the heat sink and the support structure and configured to bias the heat sink in a direction along a longitudinal axis of the downhole tool.

9. The apparatus of claim 8 wherein the heat sink is configured to engage a housing of the downhole tool and to dissipate heat from the heat generating device through the housing.

10. The apparatus of claim 8 wherein the heat sink is configured to rotate, at least partially, with respect to the body of the downhole tool.

11. The apparatus of claim 8 further comprising a thermal conduit thermally coupled to the heat generating device, wherein the heat sink is configured to dissipate heat from the heat generating device through the thermal conduit.

12. The apparatus of claim 11, wherein the thermal conduit comprises at least one heat pipe.

13. The apparatus of claim 8 further comprising a thermal conduit thermally coupled to the heat sink, wherein the thermal conduit is moveably engaged with an interior of the heat sink.

14. The apparatus of claim 13, wherein the thermal conduit comprises at least one heat pipe.

15. The apparatus of claim 8 further comprising a cover configured to couple to the heat generating device, wherein the cover is configured to dissipate heat from the heat generating device.

16. The apparatus of claim 8 wherein the heat sink is configured to tilt with respect to the longitudinal axis of the downhole tool.

17. An apparatus, comprising:

a tool to be disposed downhole within a borehole, the tool comprising:

a housing having an interior surface with a tapered mating portion;

a chassis configure to be disposed within the housing;

a heat sink thermally coupled to a heat generating device and comprising a tapered mating surface, wherein the tapered mating portion of the heat sink is configured to engage with the tapered mating surface of the housing; and a biasing mechanism engaged with the chassis and the heat sink and configured to bias the heat sink in a direction along a longitudinal axis of the tool, wherein the heat sink is configured to dissipate heat from the heat generating device.

18. The apparatus of claim 17 further comprising a thermal conduit thermally coupled to the heat generating device and to the heat sink, wherein the heat sink is configured to rotate, at least partially, with respect to thermal conduit.

19. The apparatus of claim 18 further comprising a cover configured to thermally couple to the heat pipe and the heat generating device.

20. The apparatus of claim 18, wherein the thermal conduit comprises at least one heat pipe.

* * * * *